US009011299B2

(12) United States Patent
Lien

(10) Patent No.: US 9,011,299 B2
(45) Date of Patent: Apr. 21, 2015

(54) ADJUSTABLE DUMBBELLS

(75) Inventor: Louis Lien, Bellaire, TX (US)

(73) Assignee: USA Sports, Inc., Houston, TX (US)

( * ) Notice: Subject to any disclaimer, the term of this patent is extended or adjusted under 35 U.S.C. 154(b) by 306 days.

(21) Appl. No.: 13/034,250

(22) Filed: Feb. 24, 2011

(65) Prior Publication Data

US 2012/0220434 A1 Aug. 30, 2012

(51) Int. Cl.
*A63B 21/072* (2006.01)
*A63B 21/075* (2006.01)
*A63B 71/06* (2006.01)

(52) U.S. Cl.
CPC ..... *A63B 21/075* (2013.01); *A63B 71/06* (2013.01); *A63B 21/0724* (2013.01); *A63B 21/0726* (2013.01)

(58) Field of Classification Search
CPC ..... A63B 21/072; A63B 21/075; A63B 21/0724; A63B 21/0728; A63B 21/1469; A63B 21/00065; A63B 2021/0623; A63B 21/06; A63B 21/026
USPC ..... 482/104–108, 92–94
See application file for complete search history.

(56) References Cited

U.S. PATENT DOCUMENTS 6,149,558 A * 11/2000 Chen ..... 482/107
6,261,022 B1 * 7/2001 Dalebout et al. ..... 482/107
6,500,101 B1 * 12/2002 Chen ..... 482/107
7,137,932 B2 * 11/2006 Doudiet ..... 482/107
7,377,885 B2 * 5/2008 Doudiet ..... 482/107
7,413,533 B2 * 8/2008 Lin ..... 482/108
7,429,235 B2 * 9/2008 Lin ..... 482/108
7,491,155 B2 * 2/2009 Fenelon et al. ..... 482/107
2005/0233873 A1 * 10/2005 Chen ..... 482/107
2006/0135328 A1 * 6/2006 Doudiet ..... 482/107
2007/0037675 A1 * 2/2007 Doudiet ..... 482/107
2007/0161474 A1 * 7/2007 Lippitt ..... 482/106
2007/0184945 A1 * 8/2007 Lin ..... 482/107
2009/0305852 A1 * 12/2009 Hoglund ..... 482/107
2010/0304938 A1 * 12/2010 Olson ..... 482/107
2010/0304940 A1 * 12/2010 Svenberg et al. ..... 482/108

* cited by examiner

*Primary Examiner* — Loan H Thanh
*Assistant Examiner* — Andrew S Lo
(74) *Attorney, Agent, or Firm* — Osha Liang LLP

(57) ABSTRACT

A weight lifting system includes a handle unit having a handle bar, two head units attached to two end sections of the handle bar in a manner that allows the two head units to rotate about a longitudinal axis of the handle bar, two screw rods disposed through holes in the two head units into hollow sections in the handle bar, wherein the two screw rods have threads of opposite directions, two thread-engaging mechanisms fixedly disposed at the two end sections of the handle bar to fit snugly on the threads of the two screw rods, and a lock mechanism disposed in a head unit for controlling rotation of the handle bar; and a plurality pairs of weight discs, wherein each of the weight discs has a center hole configured to accommodate one of the two screw rods.

8 Claims, 6 Drawing Sheets

ADJUSTABLE DUMBBELLS

BACKGROUND OF INVENTION

1. Field of the Invention

This invention generally relates to exercise equipment. Specifically, this invention relates to dumbbells with adjustable weights.

2. Background Art

Dumbbells and barbells are commonly used for building body strength. These strength training devices may come in various configurations. For example, dumbbells can be categorized into fixed dumbbells and adjustable dumbbells. A fixed dumbbells has a pair of weights connected with a handle. Because each fixed dumbbell has a predetermined weights, one would need a set of different dumbbells in order to have different weights. Buying many fixed dumbbells would be expensive, and their storage would take more space. Therefore, adjustable dumbbells have become popular in recent years.

An adjustable dumbbell typically comprises a set of weights that allow a user to select the desired weights before use. Therefore, a single adjustable dumbbell may be sufficient for a user's need. The design of adjustable dumbbells can range from simple to elaborate. A simple design for an adjustable dumbbell may be accomplished by having individual disc-shaped weights with holes in the center to receive a handle. A user would select a plurality of the disc-shaped weights and then secure them to the handle by a locking mechanisms (e.g., a locking plate or nut).

More elaborate designs of adjustable dumbbells would include some selection mechanisms that allow a user to select the desired weights and lock the weights to the handle with ease. The selection mechanisms may be internal or external mechanisms (e.g., a rack-and-pinion mechanism), i.e., housed in the handles or external to the handles.

For example, U.S. Pat. No. 6,261,022, issued to Dalebout et al., discloses an external mechanism, in which a rotatable gripping member is attached to a cross member on the handle. The gripping member can be rotated to different angles to engage different sets of weights via cross bars that link paired weight plates.

Internal mechanisms are housed in the handles and typically involves a pair of sliding rods inside the handles. The sliding rods can be extended or retracted to engage different numbers of weight plates on both ends of the handles. The sliding mechanisms usually involve a rack-and-pinion or similar design.

For example, U.S. Pat. No. 7,090,625, issued to Chermack, discloses a design that contains a rack-and-pinion device within the handle, a transmission mechanism to move two extendable elements, a locking mechanism, and nested weight units that have bars attached to the sides of the plates for support.

While the prior art adjustable dumbbells provide convenient choices for the users, there remains a need for better design of adjustable dumbbells.

SUMMARY OF INVENTION

One aspect of the invention relates to weight lifting systems. A weight lifting system includes a handle unit having a handle bar, two head units attached to two end sections of the handle bar in a manner that allows the two head units to rotate about a longitudinal axis of the handle bar, two screw rods disposed through holes in the two head units into hollow sections at the two end sections of the handle bar, wherein the two screw rods have threads of opposite directions, two thread-engaging mechanisms fixedly disposed at the two end sections of the handle bar to fit snugly on the threads of the two screw rods, and a lock mechanism disposed in one of the two head units for controlling rotation of the handle bar; and a plurality pairs of weight discs, wherein each of the weight discs has a center hole configured to accommodate one of the two screw rods, wherein each pair of the plurality pairs of weight discs has at least one cross bar connecting the pair of weight discs.

Other aspects and advantages of the invention will be apparent from the following description and the appended claims.

DETAILED DESCRIPTION

Embodiments of the invention relates to adjustable weight lifting systems (such as dumbbells or barbells). Such weight lifting systems have handles that can be rotated to select the desired weights. Embodiments of the invention are applicable to both dumbbells and barbells. However, for clarity, the following description will use dumbbells as examples to illustrate embodiments of the invention. One skilled in the art would appreciate that this description is equally applicable to barbells.

Figure 1:
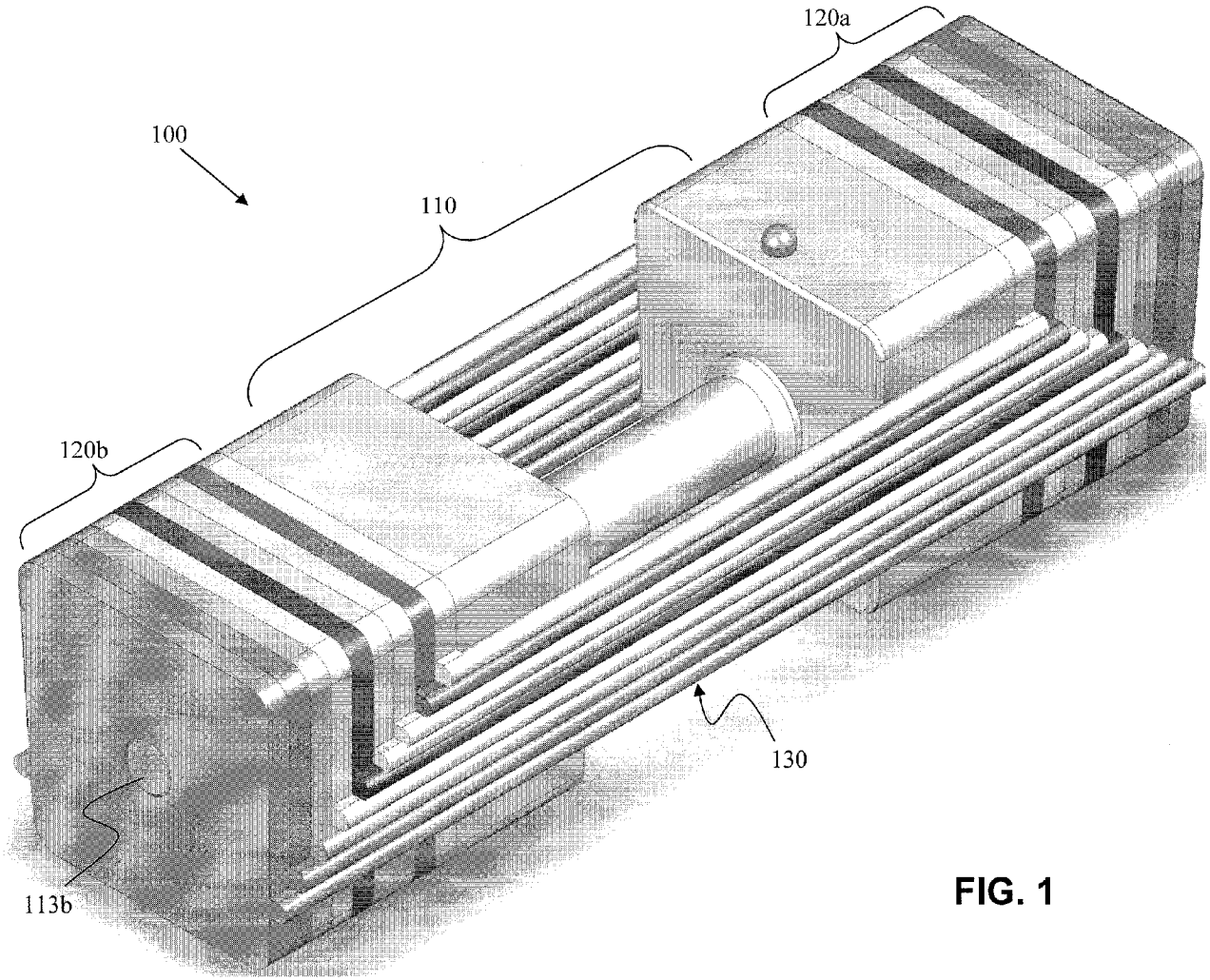
FIG. 1 shows a weight lifting system in accordance with one embodiment of the invention.

FIG. 1 shows an adjustable dumbbell in accordance with one embodiment of the invention. As shown, the adjustable dumbbell 100 comprises a handle unit 110 and a plurality sets of paired weight discs 120*a* and 120*b*. The plurality sets of paired weight discs 120*a* and 120*b* are arranged in a nesting fashion, in which the two most inner discs form the first pair, the second most inner discs form the second pair, and so forth.

The weight discs 120*a* and 120*b* shown in FIG. 1 have a substantially square cross section. One skilled in the art would appreciate that embodiments of the invention are not limited by any specific shapes of the weight discs. For example, these weight discs may have other shapes, such as round, oval, rectangular, polygonal, or other shapes.

Each weight disc has a through hole located around the center of the disc (i.e., a center hole) to accommodate a screw rod (e.g., 113*b*). The center hole may be a simple hole that allows screw rod to slide in to lift the weight disc. Alternatively, the center hole in the weight disc may be configured to engage the threads on the screw rod.

In the embodiment shown in FIG. 1, each set of the paired weight discs 120*a* and 120*b* are connected with two cross bars 130. Embodiments of the invention are not limited by any specific number of cross bars 130 connecting each pair of the weight discs. For example, the paired weight discs may be connected by a single cross bar, three cross bars, or more. These cross bars help to stabilize the weight discs. As illustrated in this embodiment, the connecting bars 130 are stacked in an orderly fashion such that the inner pairs can be lifted without interference from the cross bars for the outer pairs.

Figure 2:
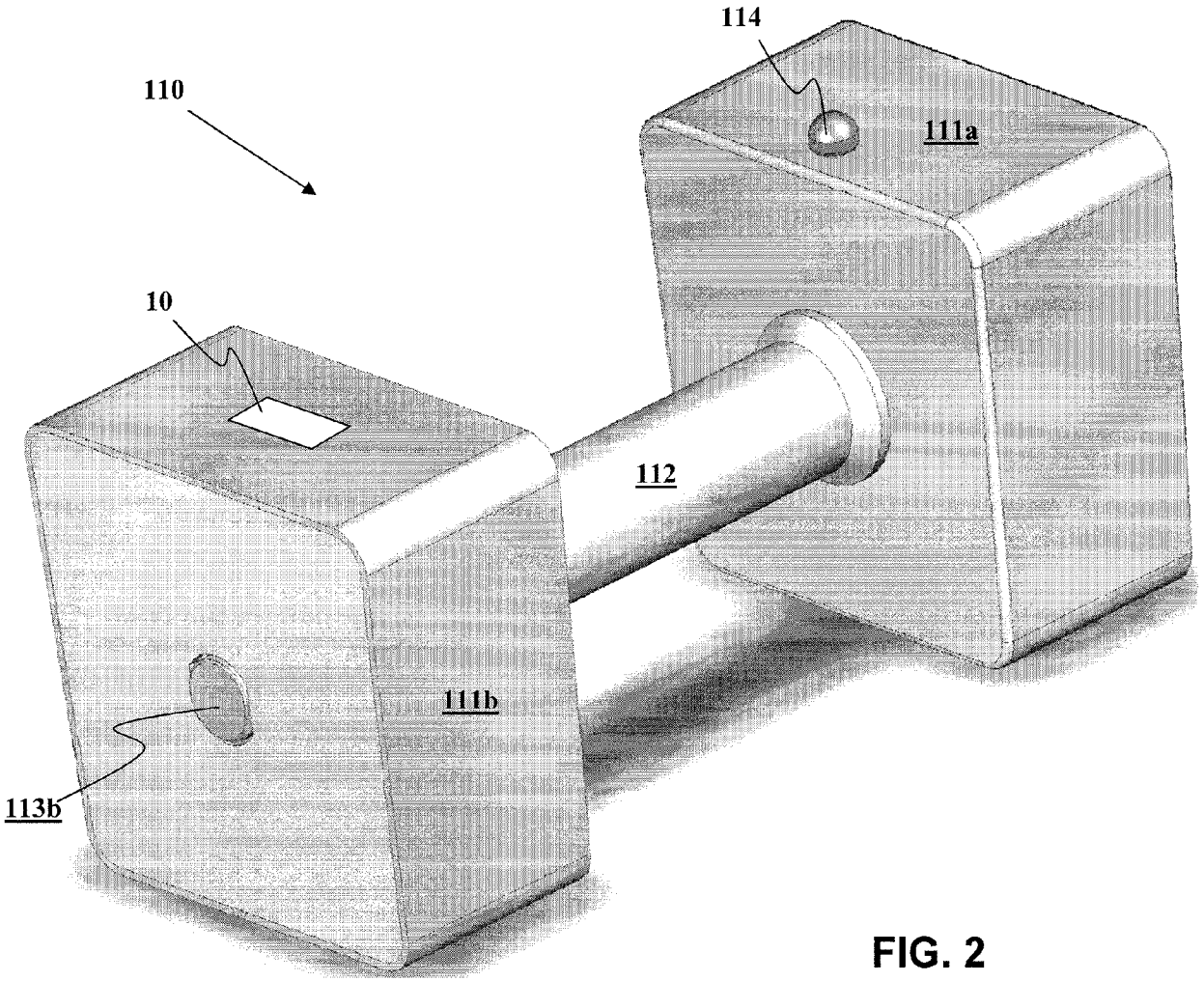
FIG. 2 shows a handle unit of a weight lifting system in accordance with one embodiment of the invention.

FIG. 2 shows a handle unit 110 from FIG. 1 in the absence of the weight discs 120*a* and 120*b*. As shown, the handle unit 110 comprises two head units 111*a* and 111*b*, disposed on two ends of a handle bar 112. The handle bar 112 may have a substantially tubular structure with hollow interior (at least at the two end sections) to accommodate two screw rods 113*a* and 113*b* therein. The hollow interior (channel) in the handle bar 112 may run the entire length of the handle bar 112 or only on both ends of the handle bar 112 (i.e., two hollow end sections with a solid center section in the handle bar 112).

Each head unit 111*a* or 111*b* has a box structure containing lock, control, or counting mechanisms that will be described in details in later sections. Although the head units 111*a* and 111*b* in this illustration are shown to have a box structure having housing walls enclosing the lock, control, or counting mechanisms therein, the box structure is not essential for embodiments of the invention. For example, some embodiments of the invention may have a single plate structure to anchor the parts for the control or counting mechanisms without enclosing these mechanisms in a box.

As illustrated in FIG. 2, each head unit 111*a* or 111*b* has a through hole on the side panel attached to the handle bar 112 and another through hole on the side panel opposite the handle bar 112 such that the screw rods 113*a* and 113*b* can extend through the head units 111*a* and 111*b*. The extended screw rods 113*a* and 113*b* are configured to engage the weight discs (shown as 120*a* and 120*b* in FIG. 1) through the center holes therein.

In accordance with embodiments of the invention, each head unit 111*a* or 111*b* is attached to the end sections of the handle bar 112 in a manner that allows the handle bar 112 to rotate around its longitudinal axis, while keeping the head units 111*a* and 111*b* stationary. Such rotations are used to control the extension or retraction of the screw rods 113*a* and 113*b* in order to engagement different sets of weight discs. The rotation control mechanism may be housed in one of the head units 111*a* and 111*b* and will be discussed in detail with reference to FIG. 4.

In the example shown in FIG. 2, the head unit 111*a* is shown to have a control mechanism 114, which controls a locking mechanism housed in the head unit 111*a*. In accordance with some embodiments of the invention, a display window 10 may be optionally included in the handle unit 110, such as on the head unit 111*b* shown in this example. The display window 10 may be used to display the extents of extension of the screw rods 113*a* and 113*b* or to display the weights of the weight discs engaged by the screw rods 113*a* and 113*b*.

Figure 3:
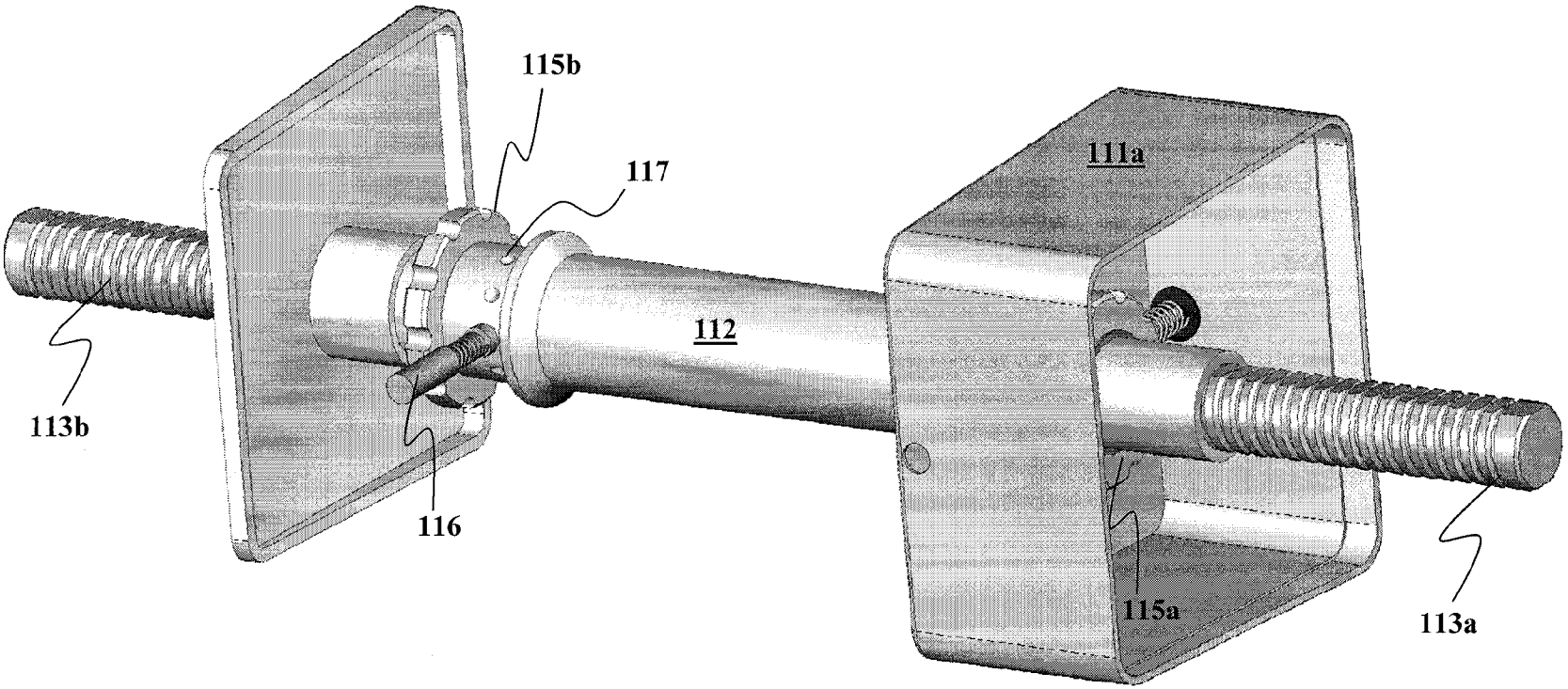
FIG. 3 shows an exposed view of a handle unit of a weight lifting system in accordance with one embodiment of the invention.

FIG. 3 shows a partially exposed view of a handle unit 110 in accordance with one embodiment of the invention. In this illustration, portions of the head unit 111*b* housing are removed to expose a control and/or display mechanism. In addition, a panel from the head unit 111*a* is also removed to exposed a locking mechanism therein.

As shown in FIG. 3, each end of the handle bar 112 is equipped with a screw cap 115*a* or 115*b*, which is fixedly attached to the handle bar 112 such that when the handle bar 112 rotates, these screw caps 115*a* and 115*b* would rotate together with the handle bar 112. These screw caps 115*a* and 115*b* are configured to engage (i.e., snugly fit) the threads on the screw rods 113*a* and 113*b*. Therefore, when the screw caps 115*a* and 115*b* rotate, the screw rods 113*a* and 113*b* will be forced to rotate pass the screw caps 115*a* and 115*b*. As a result, the screw rods 113*a* and 113*b* will be moving into or out of the handle bar 112 along the longitudinal axis of the handle bar 112.

Figure 6:
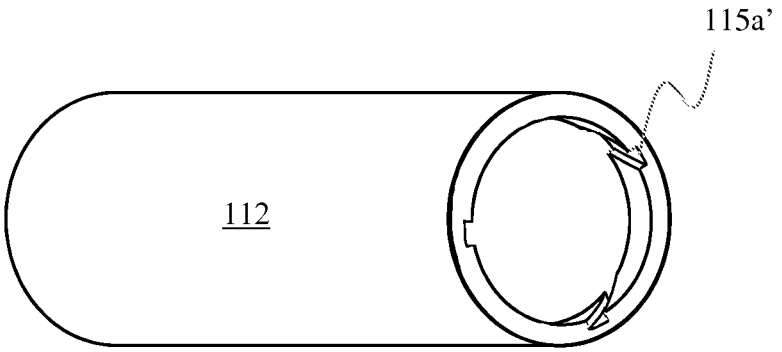
FIG. 6 shows an alternative thread-engaging mechanism that comprises a thread structure 115*a*' at the ends of the handle bar 112.

While the above example uses separate screw caps 115*a* and 115*b* that are fixed to the handle bar 112, some embodiments of the invention may have the screw caps as an integral part of the handle bar 112, i.e., a unitary piece of handle bar with "thread-engaging" mechanisms at both ends. Furthermore, according to embodiments of the invention, it is also possible to build the "thread-engaging" mechanisms inside the handle bar 112, as shown in FIG.6. That is, the inside wall of the channels (hollow sections) at both ends that accommodate the screw rods 113*a* and 113*b* can be configured to have threads (shown as 115*a*' in FIG. 6) that complement the threads on the screw rods 113*a* and 113*b*. With this construction, one can dispense with the screw caps described above. All these different configurations will be referred to generally as "thread-engaging mechanisms," whether they comprise separate screw caps, integral screw caps, or threaded structures inside the hollow sections of the handle bar.

In accordance with some embodiments of the invention, inside the head unit 111*b*, there may be a counting device 116 coupled with a plurality of dimples (or other marks) 117 arranged on a circumference of a tubular section on the handle bar for counting the extents of rotation. By counting how many dimples (or other marks) 117 passing through the end of the counting device 116, one would know the extents of rotations. Because the thread pitch on the screw rods are known, the rotation counters can be easily converted into linear translations (lengths of extension or retraction) of the screw rods 113*a* and 113*b* relative to the handle bar 112. The counts or the distance of the translation may be displayed in a display window (shown as 10 in FIG. 2) on the head unit 111*b*. Alternatively, this information may be converted into actual weights of the weight discs (based on the known weights of the discs) before it is displayed in the display window 10 (see FIG. 2).

The counting device 116 and the dimples (or other marks) 117 shown in FIG. 3 represents one way of counting the screw rod extension or retraction, and hence the weight selection. One skilled in the art would appreciate that other suitable mechanisms (electronic, optical, or mechanical mechanisms) may be used without departing from the scope of the invention. For example, the dimples 117 may be replaced with barcode marks and the counting device 116 can be a device that reads or counts the bars.

Figure 4:
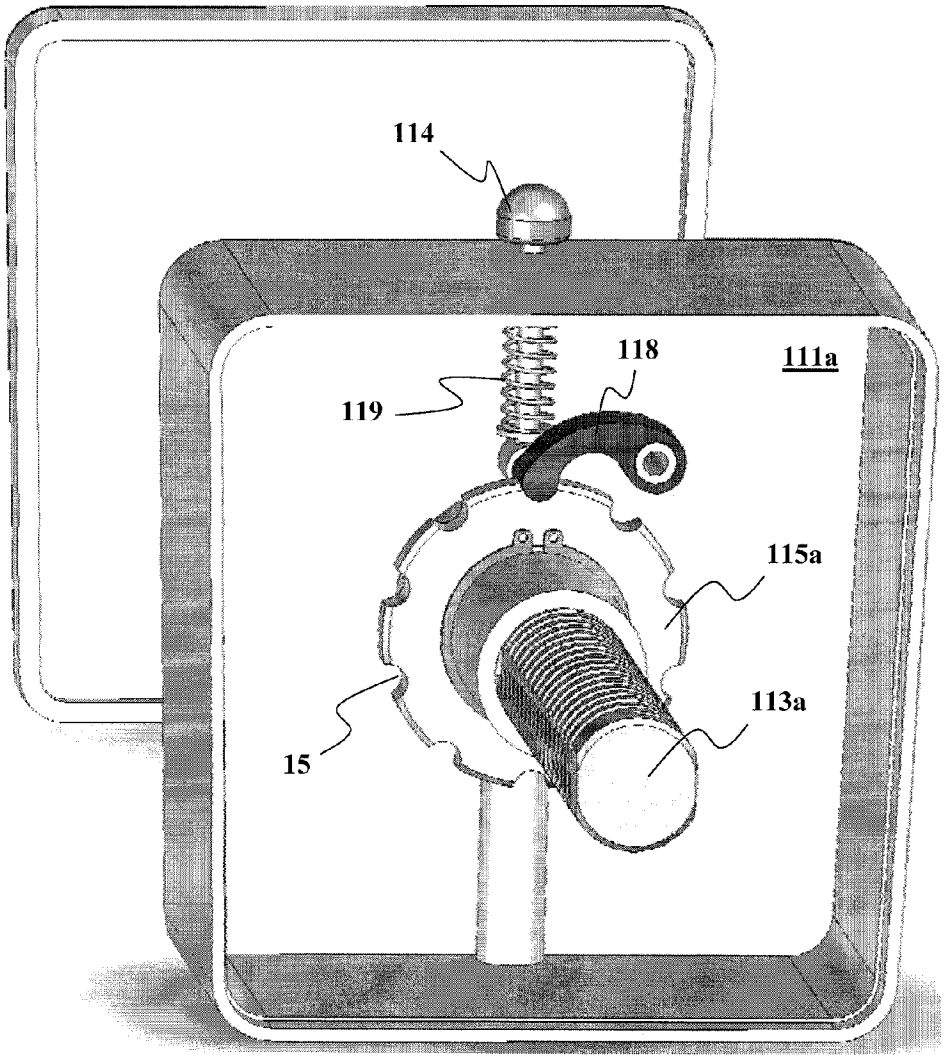
FIG. 4 shows another exposed view of a weight lifting system in accordance with one embodiment of the invention.

FIG. 4 shows a detailed view inside the head unit 111*a*, illustrating one exemplary locking mechanism in accordance with one embodiment of the invention. As shown in FIG. 4, a locking mechanism inside the head unit 111*a* comprises a screw cap 115*a*, a latch 118, and a spring 119 coupled to the control mechanism 114.

The latch 118 is fixedly attached at one end to the housing of the head unit 111*a*, while the other end of the latch 118 is movable and is attached to the spring 119 coupled control mechanism 114. The spring 119 forces the movable end of the latch 118 to engage one of the plurality of notches 15 on the screw cap 115*a*, thereby preventing the rotation of the screw cap 115*a*, which in turn prevents the extension or retraction of the screw rod 113*a*. Although not shown in this particular view, the same thing happens to the screw rod 113*b*, which will rotate or not rotate, depending on the lock status, with the handle bar 112 and the screw rod 113*a*.

To adjust weights, a user will pull the control mechanism 114 upward to lift the latch 118 off the notch 15. The disengagement of the latch 118 from the screw cap 115*a* allows the screw cap 115*a* (as well as screw cap 115*b* and the handle bar 112, which are invisible in this illustration) to be rotated. The rotation of the screw caps 115*a* and 115*b* (by rotation of the handle bar 112) will force the screw rods 113*a* and 113*b* to either extrude (extend) from or retract into the handle bar 112. The extension or retraction of the screw rods 113*a* and 113*b* results from travel (in a rotary fashion) of the screw caps 115*a* and 115*b* along the threads on the screw rods 113*a* and 113*b*.

Figure 5A:
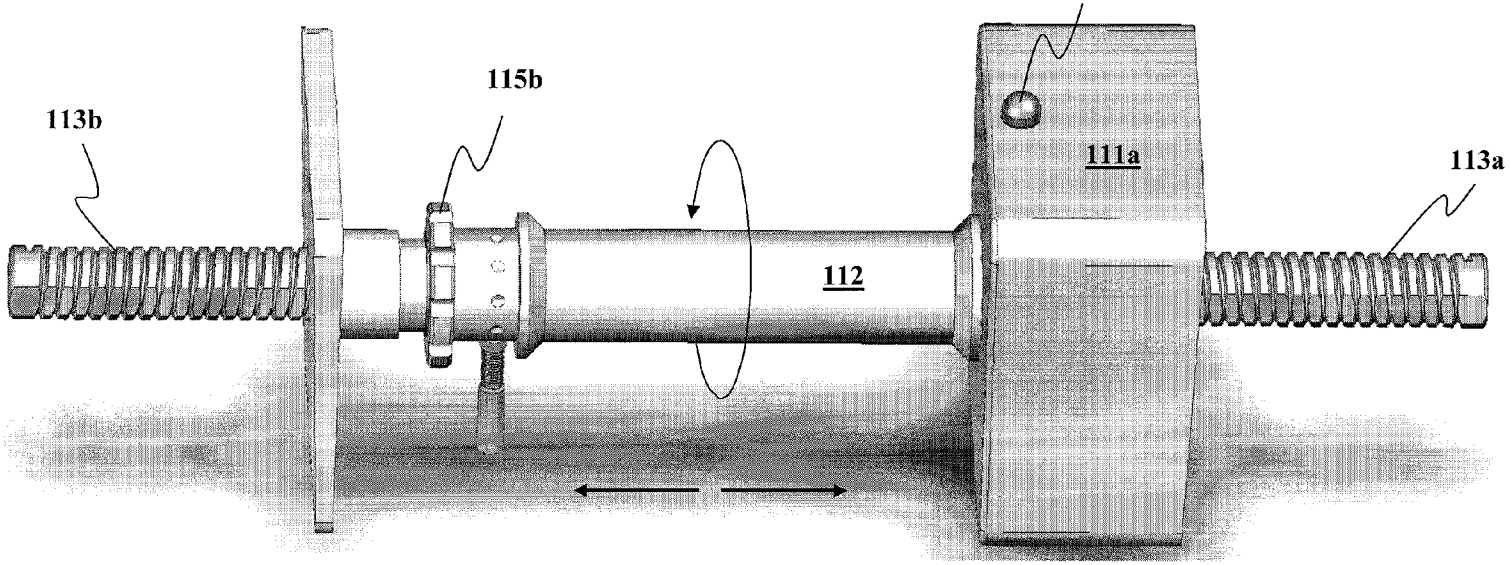
FIG. 5A shows an exposed view of a weight lifting system to illustrate a weight selection operation in accordance with one embodiment of the invention.

FIG. 5A illustrates the extension and retraction operations in more detail. As shown in FIG. 5A, the thread on screw rod 113*a* is a mirror image (with respect to a mirror plane in the middle of the handle bar 112) of the thread on screw rod 113*b*. In other words, the threads on the two screw rods are in opposite directions (clockwise vs. counterclockwise). Therefore, when the screw caps 115*a* and 115*b* are rotated in the same direction (by virtue of their fixed attachment to the handle bar 112), the two screw rods 113*a* and 113*b* will always move in the opposite directions (i.e., both extruding or retracting) along the axis of the handle bar 112.

For example, if the handle bar 112 is rotated in the direction illustrated (after pulling the control mechanism 114 up to disengage the locking mechanism in the head unit 111*a*), the two screw caps 115*a* and 115*b* will rotate in the same direction. As a result, the screw rod 113*b* will travel to the left (i.e., extend from the handle bar 112), while the screw rod 113*a* will travel to the right (i.e., also extend from the handle bar 112). Accordingly, both screw rods 113*a* and 113*b* will extend to engage more weight discs.

On the other hand, if the handle bar 112 is rotated in the other direction (not illustrated), then the two screw rods 113*a* and 113*b* will travel towards the center of the handle bar 112 (i.e., retract). As a result, fewer weight discs will be engaged by the screw rods 113*a* and 113*b*.

Once the desired weight is selected, a user will release the control mechanism 114 to re-engage the locking mechanism inside the head unit 111*a*. The locking mechanism will prevent accidental rotation of the handle bar 112, thereby preventing accidents.

Figure 5B:
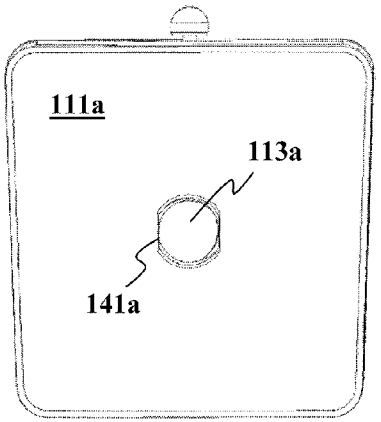
FIG. 5B shows an end view of a head unit with a screw rod fitted through a hole in the head unit in accordance with one embodiment of the invention.
Figure 5C:
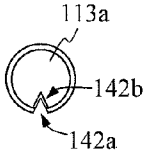
FIG. 5C shows a variation of the embodiment shown in FIG. 5B.
Figure 5D:
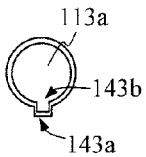
FIG. 5D shows another variation of the embodiment shown in FIG. 5B.

Note that the rotational movement of the handle bar 112 (and hence the screw caps 115*a* and 115*b*) results in translation (linear) movement of the screw rods 113*a* and 113*b* along the longitudinal axis of the handle bar 112. This is because the screw rods 113*a* and 113*b* are prevented from rotating together with the handle bar 112 and the screw caps 115*a* and 115*b*. Various mechanisms can be used to prevent the screw rods 113*a* and 113*b* from rotating with the handle bar 112. FIGS. 5B, 5C, and 5D illustrate some exemplary mechanisms.

FIG. 5B shows an end view of a handle unit, illustrating a screw rod 113*a* passing through a center hole 141*a* in the head unit 111*a*. As shown in this example, the screw rod 113*a* does not have a round cross section. The center hole 141*a* has a shape that is complementary to the "non-round" profile of the screw rod 113*a*. Because the screw rod 113*a* fits snuggly in the center hole 141*a*, the screw rod 113*a* is prevented from rotation by the head unit 111*a*. As a result, when the screw cap 115*a* rotates along the thread on the screw rod 113*a*, the screw rod 113*a* is forced to undergo translational (linear) movement in a direction along the longitudinal axis of the handle bar 112.

In addition to the mechanism shown in FIG. 5B, other suitable mechanisms may also be used to hold the screw rod "non-rotary" with respect to the head unit. For example, FIG. 5C shows a screw rod 113*a* having a trough 142*b* on one side along the length of the screw rod 113*a*, while the center hole in the head unit has a protrusion 142*a* fitting in the trough 142*b*. Similarly, FIG. 5D shows another mechanism, wherein the screw rod 113*a* has a ridge 143*b* that fits in the cutout 143*a* in the center hole of the head unit.

The above description illustrates some embodiments of the invention. One skilled in the art would appreciate that these examples are for illustration only and other modifications are possible without departing from the scope of the invention.

Advantages of embodiments of the invention may include one or more of the following. Dumbbells of the invention have the control mechanisms locate at ends of the handle bar 112. As a result, the handle bar 112 has no objects that might interfere with the gripping actions. By using two screw rods 113*a* and 113*b* traveling along the central axis of the handle bar 112, the weight discs can be engaged at the center of each disc. This will provide a balanced and more stable attachment of the weight discs to the ends of the handle bar 112. In contrast, the prior art rack-and-pinion designs (e.g., U.S. Pat. No. 7,090,625, issued to Chermack (FIG. 4)) would necessarily have two rods traveling off center relative to the central axis of the handle bar, resulting in off-centered engagement of the weight discs.

Furthermore, the rotation selection mechanism according to embodiments of the invention does not require the two screw rods to travel pass each other inside the handle bar. This allows for the use of larger diameter screw rods (as large as the hollow channel inside the handle bar would allow). In contrast, a rack-and-pinion design uses two rods and a gear mechanism, which must fit inside the handle bar, necessitating the use of smaller diameter rods. The larger diameter rods of the invention can provide stronger and more stable dumbbells.

The weight selection mechanism of the invention relies on rotation of the handle bar and two screw rods. This selection mechanism is simpler and involves fewer moving parts, as compared to the rack-and-pinion or other prior art designs. Therefore, the smart dumbbells of the invention are simpler to make and will have better reliability.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A weight lifting system comprising:

a handle unit comprising a handle bar, two head units rotatably attached to the handle bar in two end sections of the handle bar in a manner that allows the handle bar to rotate about a longitudinal axis of the handle bar, while keeping two head units stationary, two screw rods disposed through holes in the two head units into hollow sections at the two end sections of the handle bar, wherein the two screw rods have threads of opposite directions, wherein rotation of the handle bar extends or reacts the two screw rods out of or into the hollow sections at the two end sections of the handle bar, two thread-engaging mechanisms fixedly disposed at the two end sections of the handle bar to fit snugly on the threads of the two screw rods, and a lock mechanism disposed in one of the two head units for controlling rotation of the handle bar; and a plurality pairs of weight discs, wherein each of the weight discs has a center hole configured to accommodate one of the two screw rods, wherein each pair of the plurality pairs of weight discs has at least one cross bar connecting the pair of weight discs.

2. The weight lifting system of claim 1, further comprising a counting mechanism for counting an extent of rotation of the handle bar.

3. The weight lifting system of claim 2, further comprising a display window for displaying information related to the extent of rotation.

4. The weight lifting system of claim 1, wherein the two thread-engaging mechanisms comprise two screw caps.

5. The weight lifting system of claim 4, wherein the two thread-engaging mechanisms and the handle bar form a unitary piece.

6. The weight lifting system of claim 1, wherein the two thread-engaging mechanisms comprise threaded structures inside the hollow sections at the two end sections of the handle bar.

7. The weight lifting system of claim 1, wherein each pair of the plurality pairs of weight discs has two cross bars connecting the pair of weight discs.

8. The weight lifting system of claim 1, wherein the lock mechanism comprises a latch removably engaging a notch on one of the two thread-engaging mechanisms.

* * * * *